United States Patent [19]

Goldstein

[11] Patent Number: 5,035,733

[45] Date of Patent: Jul. 30, 1991

[54] ICE STORAGE AND DISTRIBUTION UNIT

[75] Inventor: Vladimir Goldstein, King City, Canada

[73] Assignee: Sunwell Engineering Company Ltd., Woodbridge, Canada

[21] Appl. No.: 494,661

[22] Filed: Mar. 16, 1990

Related U.S. Application Data

[60] Division of Ser. No. 225,711, Jun. 23, 1988, Pat. No. 4,912,935, which is a continuation-in-part of Ser. No. 97,890, Sep. 17, 1987, abandoned, which is a continuation-in-part of Ser. No. 74,834, Jul. 17, 1987, abandoned.

[51] Int. Cl.[5] ..... B01D 9/04

[52] U.S. Cl. ..... 62/541

[58] Field of Search ..... 62/330, 123, 541

[56] References Cited

U.S. PATENT DOCUMENTS

| | | | |
|---|---|---|---|
| 2,419,881 | 4/1947 | Borgerd et al. | 62/124 |
| 2,735,591 | 2/1956 | Branchflower | 222/405 |
| 3,155,459 | 11/1964 | Brown et al. | 62/541 X |
| 3,338,064 | 8/1967 | Karnofsky | 62/123 X |
| 3,825,158 | 7/1974 | Morris, Jr. | 222/238 |
| 4,129,015 | 12/1978 | Morris, Jr. | 62/344 |
| 4,341,085 | 7/1982 | Nail | 62/124 |
| 4,401,449 | 8/1983 | Martin et al. | 62/59 |
| 4,535,942 | 8/1985 | Hayashi | 241/36 |
| 4,584,843 | 4/1986 | Pronger, Jr. et al. | 62/123 |
| 4,883,520 | 11/1989 | Connery | 62/123 X |

FOREIGN PATENT DOCUMENTS

| | | |
|---|---|---|
| 107755 | 5/1984 | European Pat. Off. . |
| 168537 | 1/1986 | European Pat. Off. . |
| 668100 | 11/1938 | Fed. Rep. of Germany . |
| 480183 | 2/1938 | United Kingdom . |

*Primary Examiner*—William E. Tapolcai
*Attorney, Agent, or Firm*—Spencer & Frank

[57] ABSTRACT

An ice storage and distribution unit includes an ice storage and separation vessel for storing a slurry of ice and solution and separating the ice from the solution. An inlet slurry of ice and solution is introduced into the ice storage and separation vessel through an ice slurry inlet. The slurry separates into a bed of ice and a liquid bath of solution in the vessel. An agitator is disposed within the vessel for agitating the bed of ice to obtain substantially free-flowing ice. Ice is then discharged from the vessel through an ice outlet.

27 Claims, 11 Drawing Sheets

ICE STORAGE AND DISTRIBUTION UNIT

CROSS-REFERENCE TO RELATED APPLICATIONS

This is a divisional application of my application Ser. No. 07/225,711 filed June 23, 1988, now U.S. Pat. No. 4,912,935, which is a continuation-in-part of my application Ser. No. 07/097,890 filed Sept. 17, 1987, now abandoned, which is a continuation-in-part of my application Ser. No. 07/074,834 filed July 17, 1987, now abandoned, the entire specifications of which are incorporated herein by reference.

FIELD OF THE INVENTION

This invention relates to an ice storage and distribution unit.

TECHNOLOGY REVIEW

In the prior art, ice is transported in "dry" particle form by blowing it with air through pipes. It is essential that the particles have as low a liquid water content as possible to reduce the weight of the particles and to inhibit conglomeration thereof. It is difficult to obtain perfectly "dry" ice particles, thus the ice particles tend to be heavy and conglomerate to form large ice particles. The energy requirements of transporting the particles are high, and clogging of the transportation pipes can occur.

It is therefore an object of the present invention to obviate or mitigate the above-mentioned disadvantages.

SUMMARY OF THE INVENTION

Accordingly, the present invention provides an ice storage and distribution unit. The unit includes an ice storage and separation vessel for storing a slurry of ice and solution and separating the ice from the solution. An inlet slurry of ice and solution is introduced into the ice storage and separation vessel through an ice slurry inlet. The slurry separates into a bed of ice and a liquid bath of solution in the vessel. An agitator is disposed within the vessel for scraping the surface of the bed of ice to obtain substantially free-flowing ice. Ice is discharged from the vessel through an ice outlet.

In another one of its aspects, the present invention provides a method of storing and distributing ice. This method includes the step of introducing an inlet slurry of ice and solution into a storage and separation zone. The slurry is allowed to separate into an ice bed and a liquid bath. The ice is agitated in an agitation zone to render it substantially free-flowing. The ice is then discharged from the agitation zone.

With the present invention, a slurry of ice and brine can be separated so that the ice can be stored and then readily transported when required. Also, with the present invention, the ice can be stored without having to store also a large quantity of water, but can still be transported. The present method of storing and distributing ice also enables t he ice to be transported using less energy, and with a lower tendency to clog ice transport pipes than prior art methods.

Preferably, a storage vessel is also provided which is connected to the ice outlet of the separation vessel by a storage vessel ice inlet. Agitated ice and brine are introduced into the storage vessel through the storage vessel ice inlet. The agitated ice forms a bed of ice in the storage vessel, and entrained brine is at least partially drained from the bed of ice. A second storage vessel liquid inlet is provided for introducing liquid into the storage vessel. Agitation means are also provided in the storage vessel for agitating the bed of ice. A drain is provided in the base of the storage vessel for draining liquid therefrom. A second ice outlet is located adjacent to the agitation means, having ice transportation means located therein.

The method of the present invention can be advantageously used with the ice making machines disclosed in U.S. Pat. No. 4,551,159 (Goldstein) issued Nov. 5, 1985 and U.S. Pat. application No. 739,225 (Goldstein) filed May 30, 1985, the contents of both of which are incorporated herein by reference. These ice making machines produce a slurry of fine particles of ice in brine.

BRIEF DESCRIPTION OF THE DRAWINGS

Preferred embodiments of the invention will now be described, by way of example only, with reference to the following drawings in which.

DETAILED DESCRIPTION OF THE INVENTION

Figure 1:
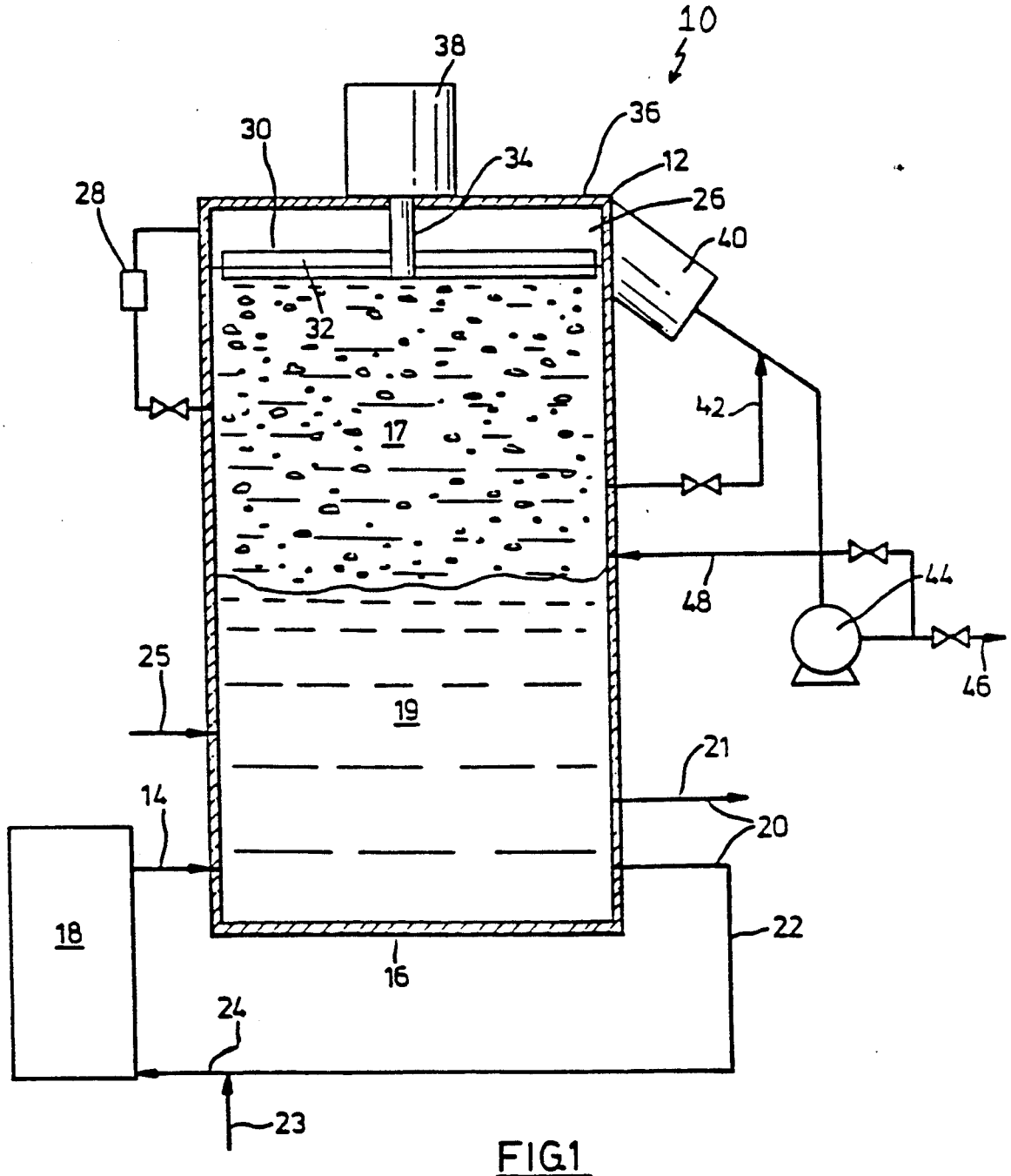
FIG. 1 is a schematic diagram of an ice storage and distribution unit.

Referring first to FIG. 1, it can be seen that an ice storage unit 10 includes a storage and separation vessel 12. A slurry inlet 14 is located near the base 16 of the vessel 12 and connects an ice generation unit 18 to the vessel 12. Also at the base 16 of the vessel 12 is a pair 20 of liquid outlet lines 21, 22 one of which 21 leads to a drain, and the other of which 22 is connected to a brine inlet 23 and leads to the inlet 24 of the ice generation unit 18. Above the slurry inlet 14, is a makeup water inlet 25 to allow flow of makeup water into t he vessel 12.

At the upper part 26 of the vessel 12, a level control device 28 is located. Adjacent to this control device 28 is a blade assembly 30, comprising three blades 32 mounted on a rotatable shaft 34. This shaft 34 extends through the top 36 of the vessel 12 where it is connected to a motor 38. Adjacent to t he blades 32 is an ice outlet 40.

Connected at one end to the vessel 12 and at the other end to this ice outlet 40 is a brine feed pipe 42. The ice outlet leads to a pump 44, which is connected to a distribution pipe 46. A recycle pipe 48 is connected at one end to the distribution pipe 46 and at the other end to the vessel 12.

The operation of the unit will now be described with reference to FIG. 1. A slurry of ice particles and brine solution are generated in the ice generating unit 18, and introduced into the storage and separation vessel 12 through the slurry inlet 14. This ice generating unit 18 is disclosed in U.S. Pat. application No. 739,225.

The ice and solution are allowed to separate in the vessel into an ice bed 17 and a liquid bath 19. Liquid from the liquid bath can be recycled back to the ice generating unit 18 to generate additional slurry or can be drained. Ice can be continuously generated and fed into the vessel 12 to build up a bed of ice in the vessel 12. The level detector is used &o measure the level of ice in the vessel and sufficient makeup water is added to the makeup water inlet 25 to maintain the ice bed at the level of the blades 32. The blades 32 are rotated by the motor 38 to scrape the surface of the ice bed. The scraped, substantially liquid-free ice is discharged through the ice outlet 40 and is mixed with liquid from the liquid bath through the brine feed pipe 42. The resultant slurry is passed through the pump 44 and is recycled to the vessel 12 through the recycle pipe 48. The recycled ice tends to fuse with larger ice particles already present in the vessel to create larger, more easily drained ice particles. If ice is required, the ice is not recycled to the vessel through the recycle pipe 48, but is instead sent directly through the distribution pipe 46 to the desired location.

Figure 2:
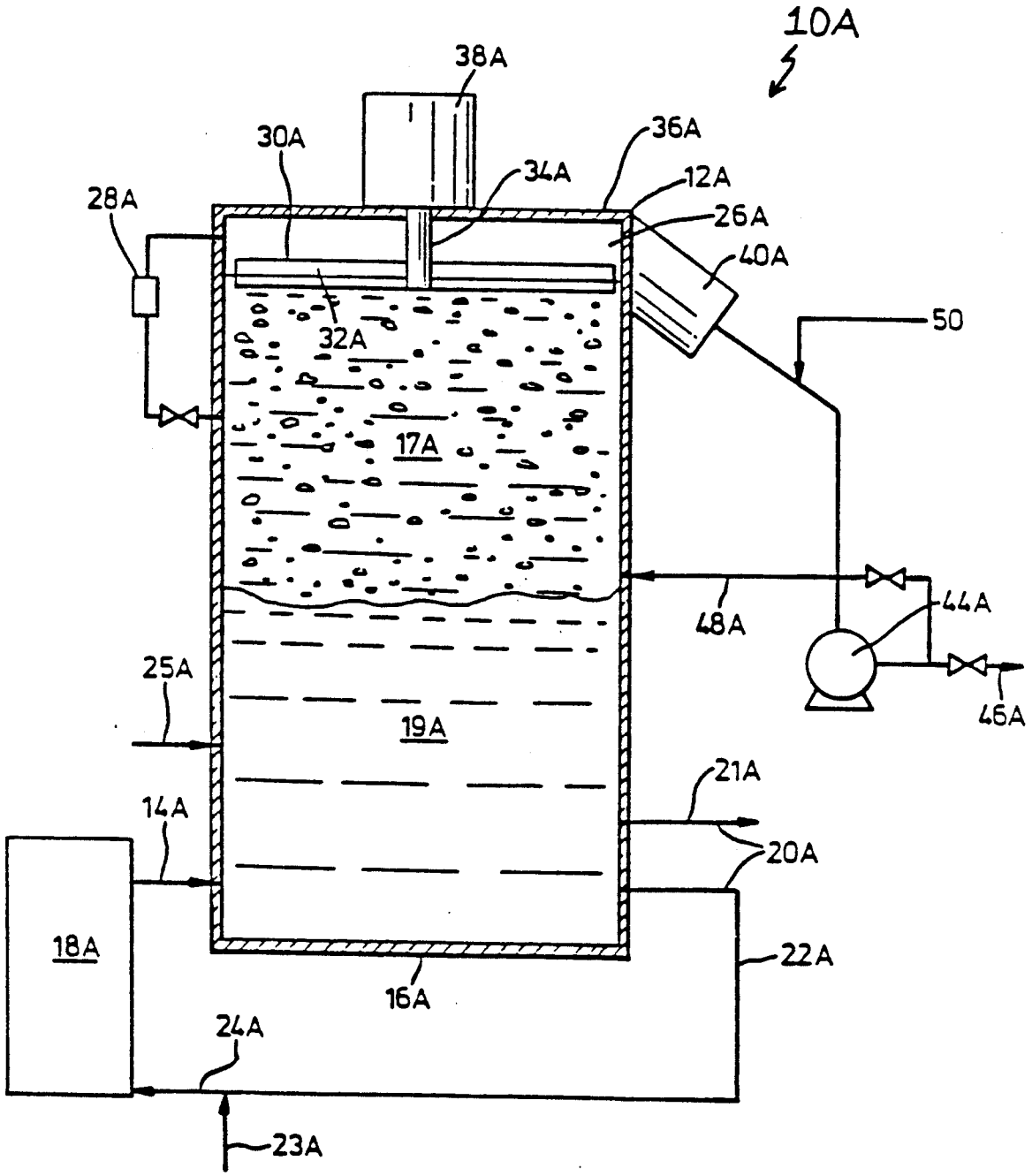
FIG. 2 is a schematic diagram of an alternative embodiment of the ice storage and distribution unit of FIG. 1.

FIG. 2 shows an alternative embodiment of the ice storage and distribution unit showing in FIG. 1. Elements similar to those shown in FIG. 1 are indicated by the same reference numeral followed by the suffix "A". In this embodiment the apparatus and method of operation are similar to those of FIG. 1 except that fresh water is added to the ice in the ice outlet 40A through a fresh water pipe 50 instead of salt water. Optionally, fresh water is also sprayed onto the surface of the ice bed in the vessel through a nozzle to rinse out any salt water entrained in the ice bed.

Figure 3:
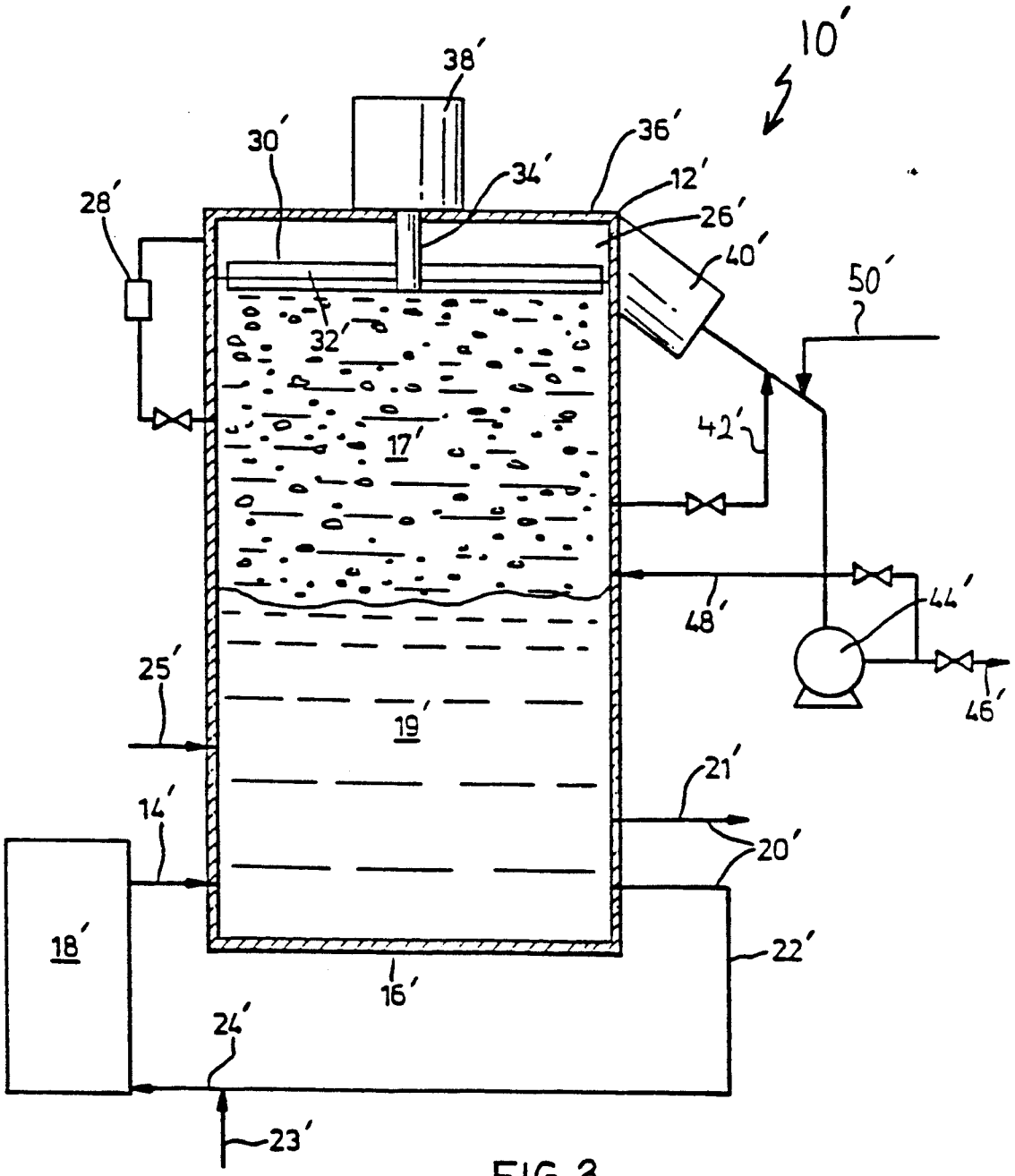
FIG. 3 is a schematic diagram of another alternative embodiment of the ice storage and distribution unit of FIG. 1.

FIG. 3 shows yet another alternative embodiment of the ice storage and distribution unit shown in FIG. 1. Elements similar to those shown in FIG. 1 are indicated by the same reference numeral followed by a "'" added for clarity. In this embodiment the apparatus and method of operation are similar to those of FIGS. 1 and 2 except &hat brine and fresh water are added to the ice in the ice outlet 40' through the brine feed pipe 42' and a fresh water pipe 50' respectively. Although not shown, the fresh water pipe 50' and the brine feed pipe 42' may be connected at the pump 44' discharge as opposed to the ice outlet 40'.

Figure 4:
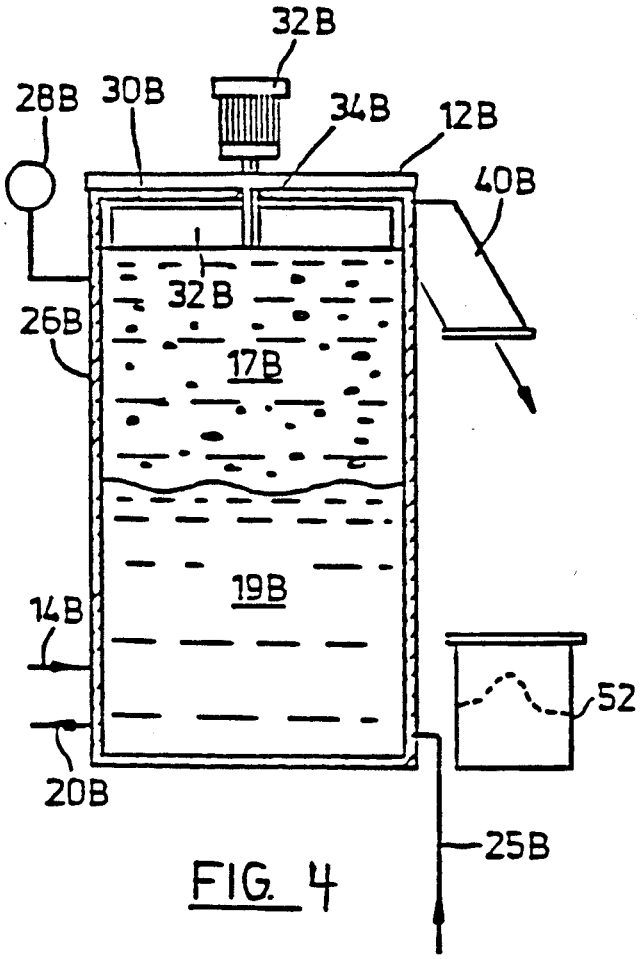
FIG. 4 is a schematic diagram of another alternative embodiment of the unit of FIG. 1.

FIG. 4 illustrates another alternative embodiment of the unit. Elements similar to those shown in FIG. 1 are indicated by the same reference numeral, followed by the suffix "B". In this embodiment, the apparatus and method of operation are similar to those of FIG. 1 except that the outlet 40B discharges directly into a container 52 by gravity, rather than being pumped as a slurry.

Figure 5:
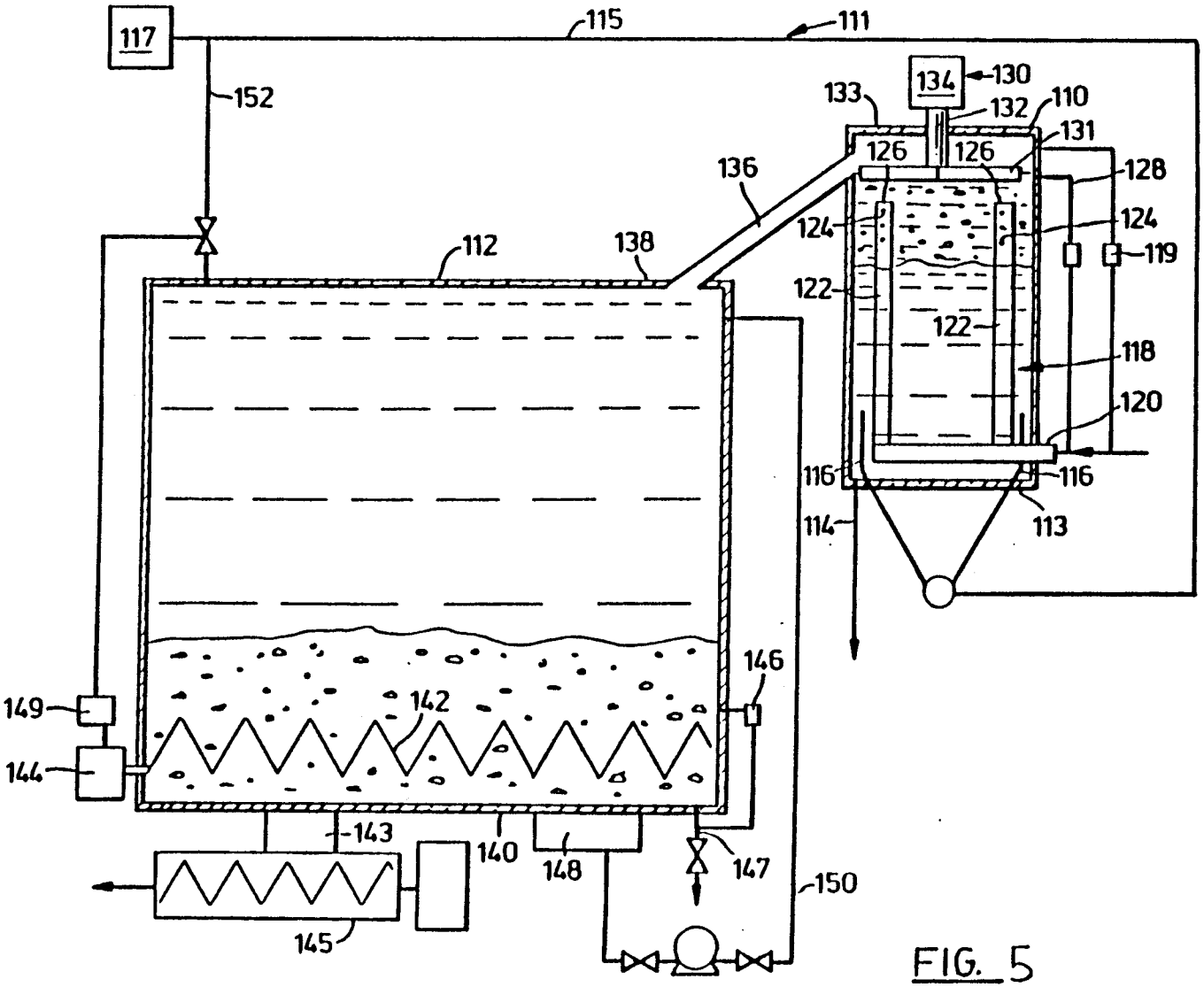
FIG. 5 is a schematic representation of an apparatus to store and transport an ice and brine slurry.

Referring to FIG. 5, it can be seen that an ice generating unit 111 comprises a circular cross-sectioned separation vessel 110 and a square cross-sectioned storage vessel 112.

A drain 114 is located at the base 113 of the separation vessel 110 and a pair of diametrically-opposed makeup liquid inlets 116 are located above the drain. These inlets 116 are directed tangentially relative to the vessel 110. A makeup water line 115 is connected to the inlets 116 and a prechiller 117 is located in the makeup water line to prechill the makeup water.

Located inside the vessel 110 is a first ice and brine inlet 118 comprising a horizontal pipe 120 extending across the vessel 110 below the makeup liquid inlet 116 and a pair of risers 122 extending therefrom. These risers have openings 124 in the upper ends 126 thereof, through which ice and brine enter the vessel 110. A level control device 128 is associated with the inlet to maintain the level of ice and liquid in the vessel 110 at a preset height. A timer control unit 119 can be used to adjust t he level.

Above the risers 122 is located a blade assembly 130. This assembly 130 comprises three scraper blades 131 mounted on a rotatable shaft 132. This shaft 132 extends through the top 133 of the vessel 110 and is connected to and rotatable by a motor 134 located outside the vessel 110.

Adjacent to the blades is located a first ice outlet 136. This outlet 136 is connected to the top 138 of the storage vessel 112. In the base 140 of the storage vessel 112 is disposed a plurality of agitators 142. These agitators 142 are each rotatable by a respective motor 144 located outside the storage vessel. Torque measuring devices 149 are used to measure the torque on the agitators 142 and when the torque is above a predetermined level, additional makeup water is added through line 152 to raise the level of the ice bed. Below the agitators 142 is a second ice outlet 143 with an augur 145 located therein. A level detector 146 is located near the base 140 of &he storage vessel 112, to detect the level of liquid within the storage vessel 112. This level detector is associated with a drain pipe 147. Adjacent to the level detector 146 in the base 140 of the storage vessel 1!2 is a drain 148. A recycle line 150 is connected to the drain 148 at one end and to the top 158 of the storage vessel 112 at the other end. A pump 151 is located in the recycle line 51 to pump liquid from the drain 148 to the top of the storage vessel 112.

The operation of the apparatus is as follows. Makeup liquid is continuously fed into the separation vessel 110 through the makeup liquid inlets 116. The tangential orientation of the inlets imparts a vortex on the makeup liquid entering the tank. A slurry of fine ice particles and brine generated by an ice generation unit such as that disclosed in U.S. Pat. application No. 739,225, is continuously fed into the separation vessel through the first ice and brine inlet 118. The ice forms a dense uniform layer in the separation vessel 110, through which only some of the brine can drain. The ice layer thereby forms a piston which is held above the makeup water due to the pressure exerted on the ice layer by the makeup water.

The makeup water and the ice and brine slurry are continuously added to the separation vessel 110 to maintain the ice layer at the level of the blades 131. The blades 131 are continuously operated to scrape the top surface of the ice layer. The scraped ice and entrained brine are fed into the storage tank 110 through the first ice outlet 136.

The crystal structure of the ice is altered by the cutting action of the blades, so that larger, more easily drained ice crystals are obtained in the storage vessel 112. As the scraped ice particles fall into the storage vessel 112, the entrained brine drains therefrom. In the storage vessel, the scraped ice particles fuse with other ice particles to form larger ice particles. The drained brine from the ice falls into the drain 148 and the ice is stored in the storage vessel 112.

When it is desired to transport the ice, the drained brine is recycled to the t op of the vessel 112 through the recycle line 150. Additional salt water is also fed into the vessel 112 through the salt water inlet 152. The agitators are then actuated. The recycled brine and the additional salt water are added to the ice at the level of the agitators 142 to assist in the agitation of the ice, and to maintain a ice slurry. The augur 145 is then actuated and ice is transported to the outlet 143 and pumped to a desired location.

Figure 6:
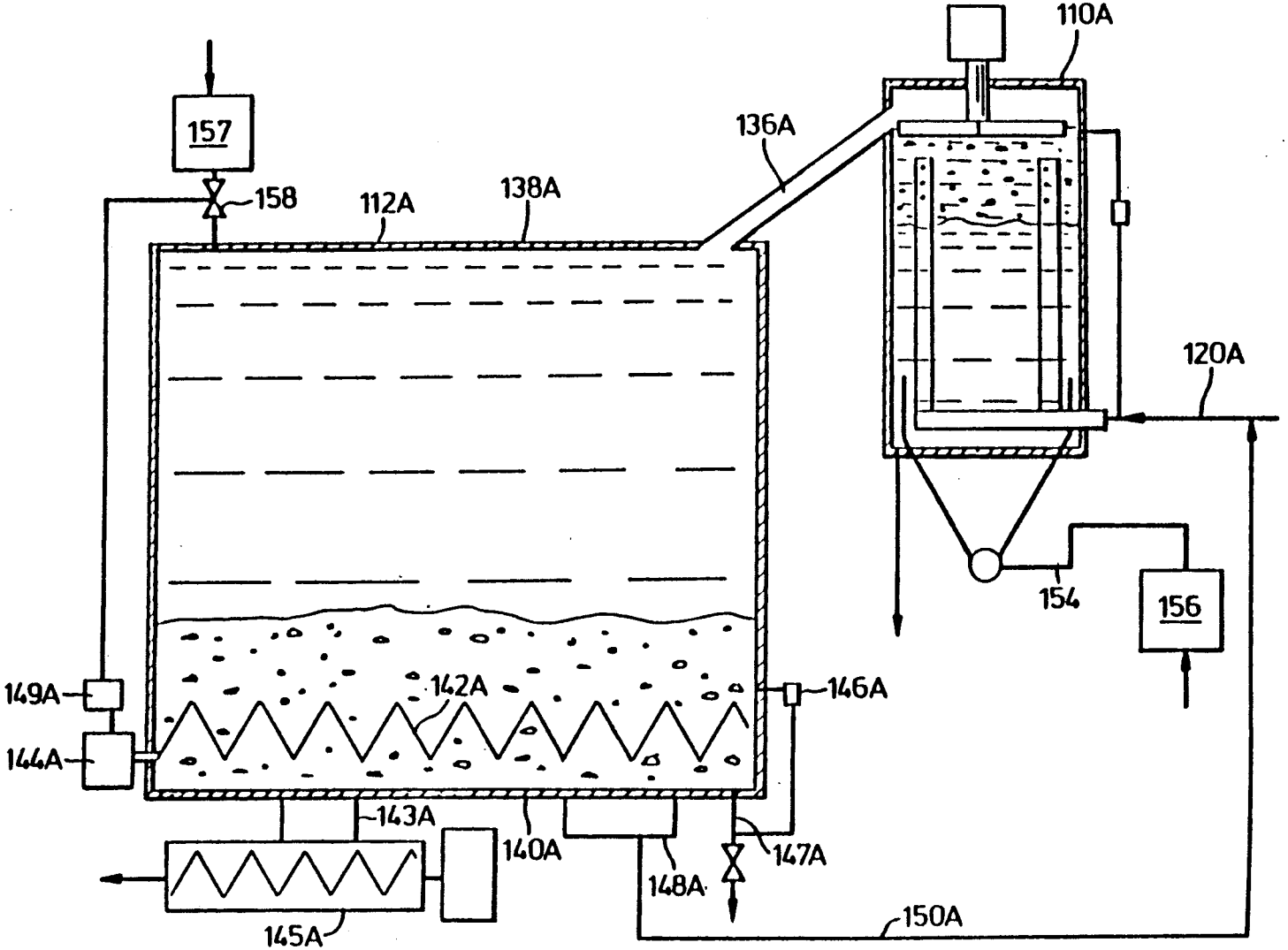
FIG. 6 is a schematic representation of an alternative embodiment of the apparatus of FIG. 5 to store and transport an ice and water slurry.

FIG. 6 shows an alternative embodiment of the ice storage and distribution unit 11, wherein an ice and fresh water slurry is provided. Elements of the apparatus which are the same as those in FIG. 5 are given the same reference numeral, followed by the suffix "A".

The apparatus and process of the embodiment of FIG. 6 are the same as that of FIG. 5 except that the recycle line 150A from the drain 148A is connected to the first ice and liquid inlet line 120A, rather than to the top 138A of the storage vessel 112A. Also, fresh makeup water is introduced in the first vessel 110A through line 154 which is first prechilled in prechiller 156. In the second vessel 112A, fresh water is prechilled in prechiller 157 and is introduced into the vessel through line 158.

The apparatus of FIG. 6 operates as follows. In the storage vessel, the brine is drained from the ice and is recycled to the separation vessel through recycle line 150A. The ice in t he storage vessel is then sprayed with fresh water from liquid inlet 158 to rinse the ice and remove the remaining salt water therefrom and is drained and recyCled tO the separation vessel. When ice is required, the agitators are actuated. A slurry of fresh water and ice is then removed from the storage tank through the augur 145A.

Figure 7:
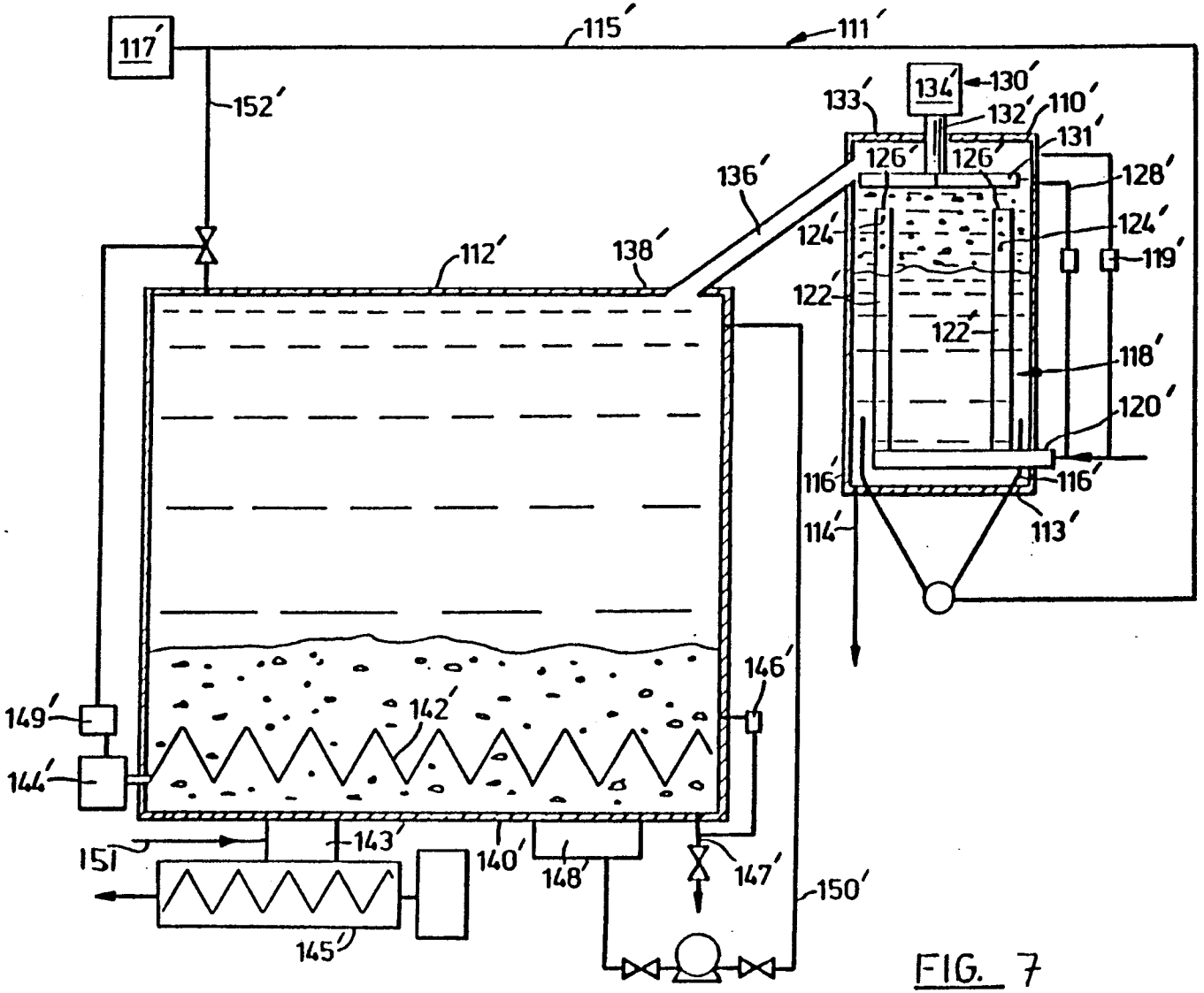
FIG. 7 is a schematic representation of an alternative embodiment of the apparatus of FIG. 5 to store and transport an ice, brine and water slurry.

FIG. 7 shows yet another alternative embodiment of the ice storage and distribution unit 11', wherein an ice, brine and fresh water slurry is provided. Elements of the apparatus which are the same as those in FIG. 5 are given the same reference numeral, followed by a "'" added for clarity.

Figure 8:
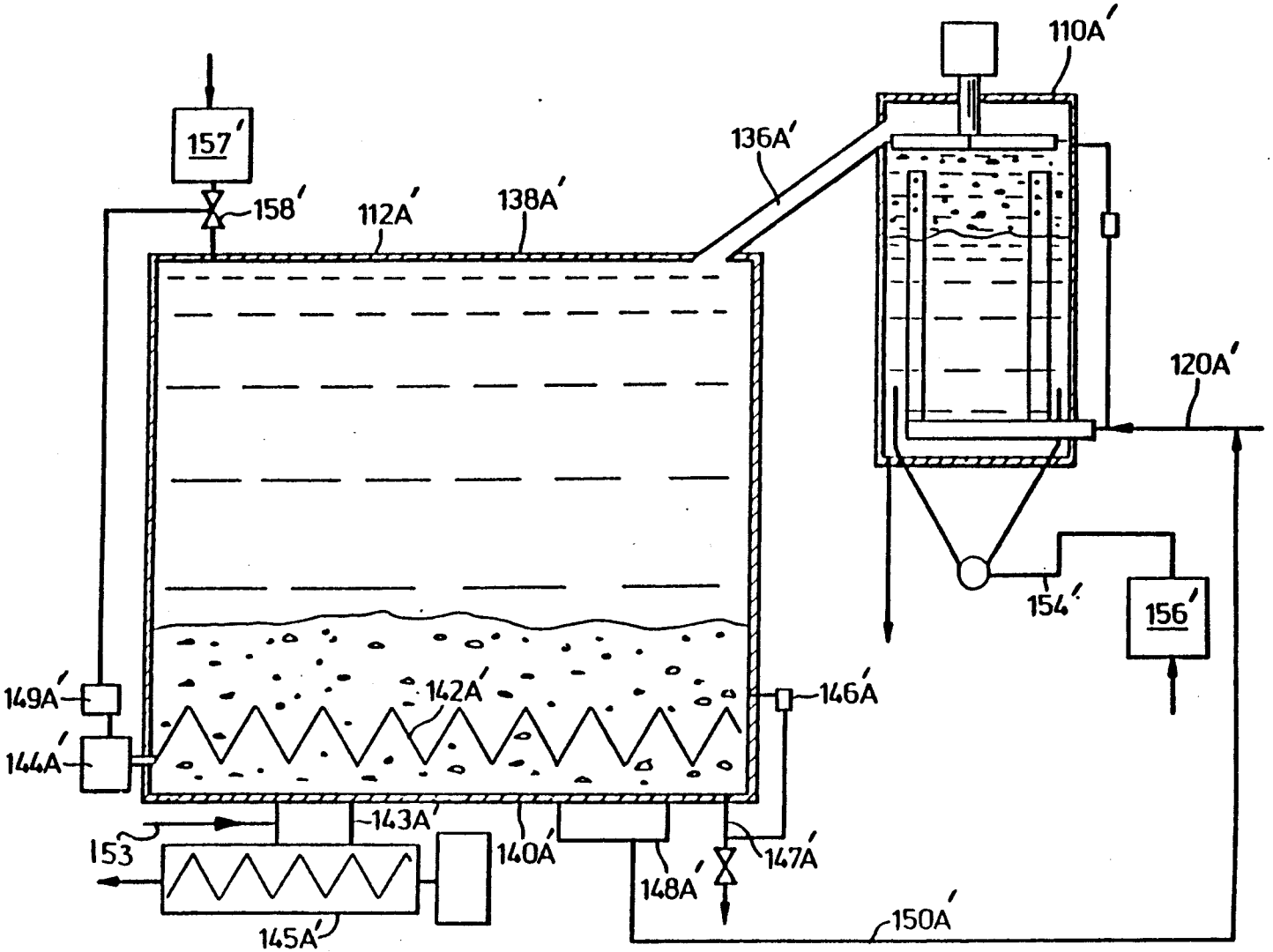
FIG. 8 is a schematic representation of an alternative embodiment of the apparatus of FIG. 6 to store and transport an ice, brine and water slurry.

The apparatus and process of the embodiment of FIG. 7 are the same as the embodiment of FIG. 5 except that fresh water is introduced in the second ice outlet 143' through line 151 which is first prechilled in a prechiller (not shown). Alternatively, the fresh water pipe 151 may be connected to the auger 145' discharge as opposed to the outlet 143'. Thus, this embodiment provides an ice, brine and water slurry. The embodiment of FIG. 6 may also be modified as shown in FIG. 8 to provide a brine feed pipe 153 at the outlet 143A' thereby resulting in an ice, water and brine slurry. Similar to the embodiment in FIG. 7, the brine feed pipe 153 may be connected at the auger 145A' discharge as opposed to the outlet 143A'.

Figure 9:
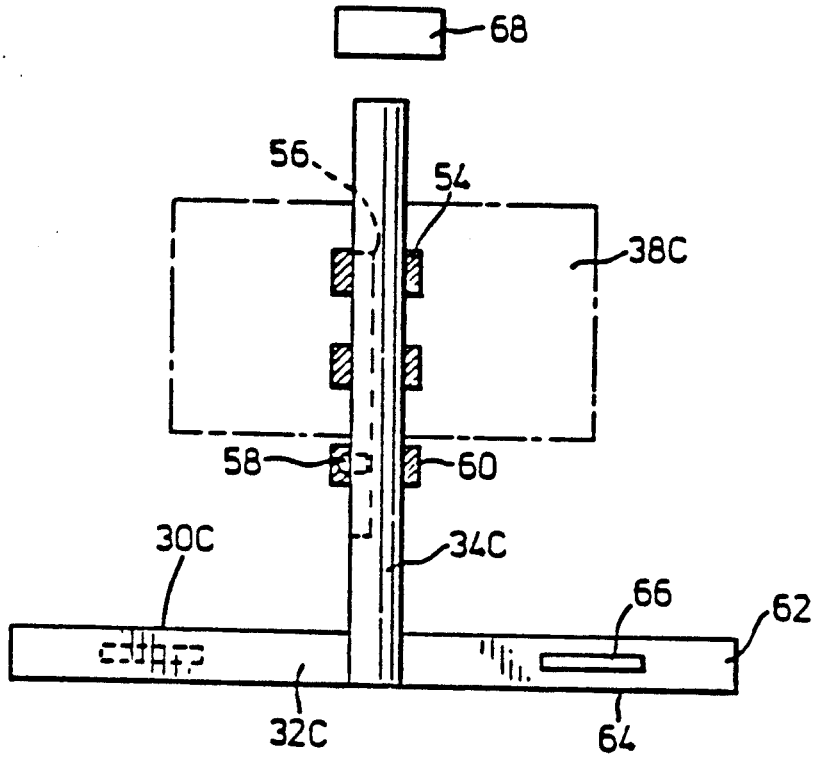
FIG. 9 is a side view in partial cross-section of a blade assembly to be used in the units of FIGS. 1 to 8.
Figure 10:
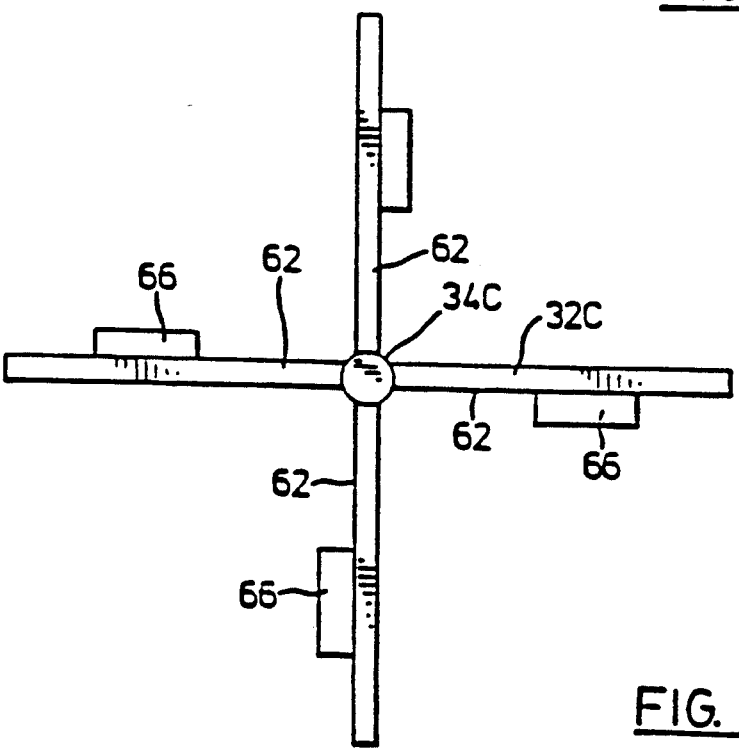
FIG. 10 is a view from below of the blade assembly of FIG. 9.

FIGS. 9 and 10 show an alternative embodiment of the blade assembly of FIGS. 1 to 8. Elements similar to those shown in FIG. 1 are indicated by the same reference numeral, followed by the suffix "C". In this embodiment, the assembly 30C floats on the surface of the ice. The assembly 30C is similar to that shown in FIGS. 1 to 8 except that the shaft 34C is slidably located in bearings 54 of motor 38C. The shaft 34C has a groove 56 extending longitudinally over a portion thereof into Which is slidably keyed a key 58 connected to the drive shaft 60. Attached to the trailing end 62 of each blade 32C just above the cutting edge 64 is a horizontally extending ski 66.

In operation, skis 66 rest on the surface of the ice bed and the cutting edge 64 of the blade 32C extend into the bed to cut the bed. When the bed rises or falls. the blade assembly 30C rises or falls within the limits defined by the groove 56 and key 55. When the vessel is full of ice and liquid, the assembly 30C will be at its maximum height and a limit switch 68 will be activated by the shaft 32C to drain the vessel.

Figure 11:
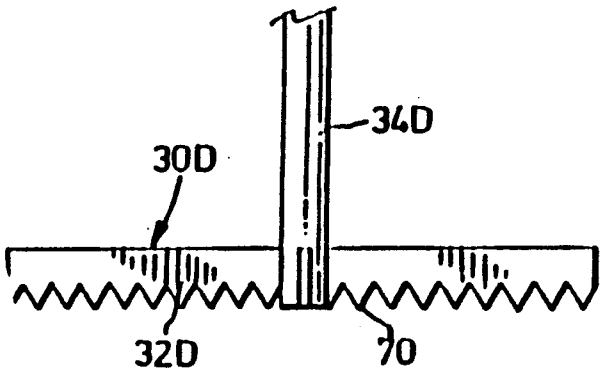
FIG. 11 is a side view of an alternative embodiment of a blade assembly to be used with the apparatuses of FIGS. 1 to 8.

FIG. 11 shows an alternative design of the blades of a blade assembly suitable for use with the embodiments of the invention illustrated in FIGS. 1 to 8. Elements similar to those shown in FIG. 1 will be given the same reference numeral followed by the letter "D". As can be seen in FIG. 11, these blades 32D have serrated cutting edges 70. These blades 32D tend to plow the bed to break up capillaries in the ice bed. The action of the blades leaves peaks and troughs in the ice bed surface, which allow the water to drain more quickly from the ice bed.

Figure 12:
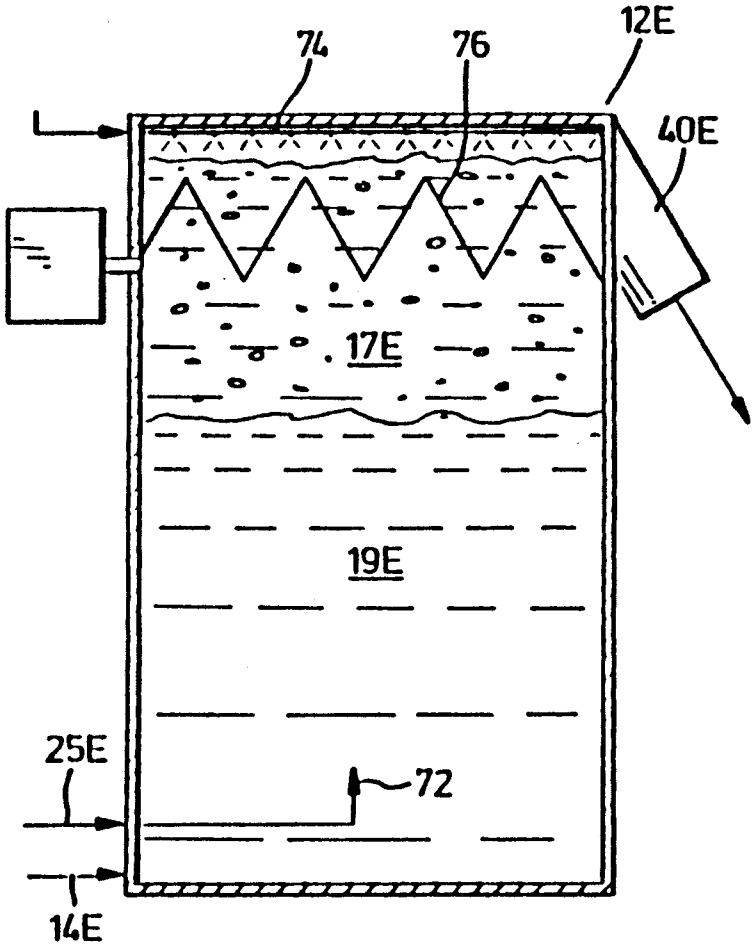
FIG. 12 is an alternative embodiment of an ice storage and distribution unit.

FIG. 12 is another alternative embodiment of the invention. Elements similar to those shown in FIG. 1 will be given the same reference numerals, followed by the letter "E".

In this embodiment, makeup water is added to the vessel 12E slowly through a central inlet 72. By adding makeup water slowly to the vessel, the solution present in the vessel is maintained in a quiescent state. A concentration gradient is thereby set up in the vessel. Since brine is denser than water, the concentration of salt will be lower at the bottom of the vessel than near the top. At the top of the vessel 12E, a liquid distributor is located. Fresh water is sprayed onto the surface of the bed by this distributor.

With this configuration, fresh, salt-free ice can be obtained relatively quickly.

Also shown in this embodiment is an auger 76. An auger or a plurality of augers can be used to replace the blade assembly when a rectangular tank is used instead of a cylindrical tank. This agitator can replace the blade assembly used in the embodiments of FIGS. 1 to 8 if the tanks in these embodiments were rectangular.

Figure 13:
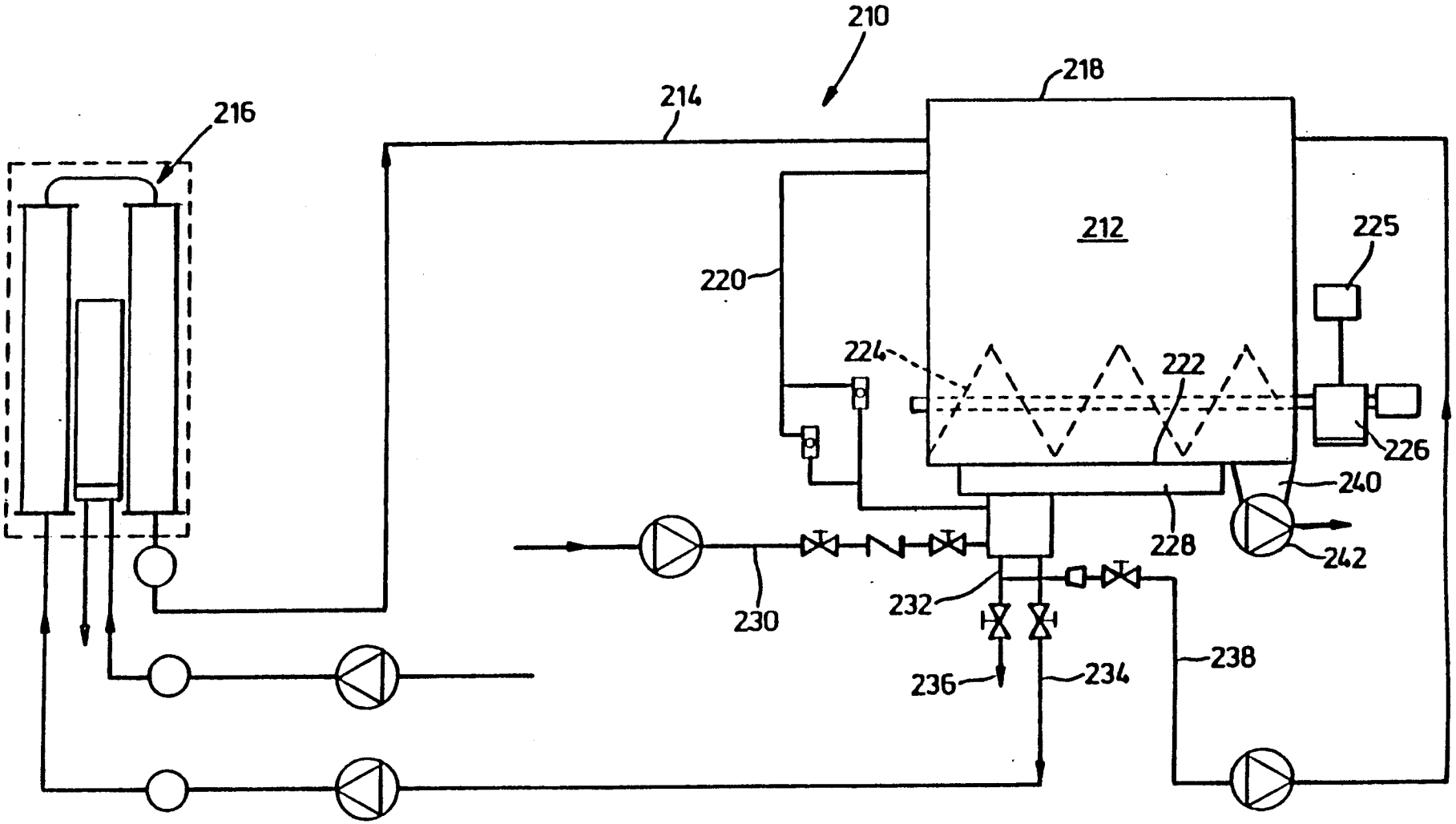
FIG. 13 is an additional alternative embodiment of an ice storage and distributioN unit.

FIG. 13 shows an embodiment to the invention suitable for use on board a ship.

As can be seen in this figure, the storage and distribution unit 210 includes a rectangular cross-sectioned vessel 212. A slurry inlet 214, leading from an ice generation unit 216 similar to that disclosed in U.S. Pat. application No. 739,225 is connected near the top 218 of this vessel 212. Beneath this slurry inlet 214 is located a level detector 220, which measures the level of liquid in the vessel 212.

In the base 222 of the vessel 212 there are located a plurality of agitators 224 which extend across the length of the base 222. These agitators 224 are each operated by a motor 226 located outside of the vessel 212. A torque measuring device 225 is associated with the agitators 224.

Depending from the base 222 of the vessel is a sump 228. A makeup water inlet 230 and two liquid outlets 232, 234 are connected to this sump 228. One 232 of the liquid outlets is connected to a drain 236, and to a liquid recycle pipe 238 which is connected to the top 218 of the vessel 212. The other 234 of the liquid outlets is connected to the ice generation unit 216. Adjacent to the sump 228 is located an ice outlet 240 which has a pump 242 located therein.

The operation of the unit is as follows. First slurry is generated in the ice generation unit 216, and this slurry is introduced into the vessel 212. The water level in the vessel can be kept constant, or brine can be removed from the vessel and a makeup water added through inlet 230 when the brine concentration gets too high. The brine concentration can be monitored by a temperature gauge. The liquid being removed drains into the sump 228 and can be recycled to the ice generation unit through liquid outlet 234. More slurry from the ice generation unit 216 is fed into the vessel 212, until a bed of ice is built up in the vessel 212.

When ice is required, the agitators 224 are actuated to agitate the ice, and the ice is discharged through the ice outlet 240 and is pumped to the desired location.

The torque measuring device 225 measures the torque exerted by the agitators and makeup water is added via line 230 when the torque is increased beyond a predetermined amount.

If fresh water ice is desired instead of salt water ice, the recycle pipe 234 could be removed, and fresh water could be sprayed into the top of the vessel to wash out any entrained salt water in the ice. Fresh water could then be added through the makeup liquid inlet 230 when required. If an ice, brine and fresh water slurry is desired, a fresh water feed pipe can be connected to the outlet 240 or to the auger 242 discharge.

This embodiment is particularly suitable for use on board a ship to inhibit splashing and spillage of water since the upper portion of the tank is largely empty. Alternatively, the tanks of FIGS. 1 to 8 could be sealed when used on board a ship, however, the expansion of ice would have to be compensated for under certain circumstances.

We claim:

1. A method of storing and distributing ice comprising the steps of:

introducing an inlet slurry of fine particulate ice and solution into a separation zone;

allowing the slurry to separate into an ice bed and a liquid bath in said separation zone;

agitating said ice bed in an agitation zone;

discharging agitated ice from said agitation zone;

monitoring the level of said ice bed in said agitation zone; and introducing makeup liquid into one of said separation and agitation zones to maintain the level of said ice bed at a predetermined level in said agitation zone.

2. The method of claim 1 further including the step of adding liquid to said agitated ice to form an outlet ice slurry.

3. The method of claim 2 further including the step of recycling at least a portion of said outlet ice slurry back into said separation zone.

4. The method of claim 1 wherein said makeup liquid is introduced into said separation zone.

5. The method of claim 4 wherein said makeup liquid is released slowly in the center of a lower portion of said liquid bath.

6. The method of claim 1 wherein the agitation zone moves with said ice bed.

7. The method of claim 2 wherein the liquid added to said agitated ice is fresh water.

8. The method of claim 2 wherein the liquid added to said agitated ice is salt water.

9. The method of claim 2 wherein the liquid added to said agitated ice includes fresh water and salt water.

10. The method of claim 8 wherein said salt water is obtained from the liquid bath in said separation zone.

11. The method of claim 1 further comprising the step of draining solution from said liquid bath.

12. The method of claim 1 wherein the agitation zone is in a lower portion of said separation zone.

13. The method of claim 1 wherein the agitation zone is in an upper portion of said separation zone.

14. The method of claim 1 further comprising the steps of:

transporting the agitated ice to a second storage zone;

draining liquid from said ice in said storage zone; and storing the ice in said storage zone.

15. The method of claim 14 further comprising the steps of adding liquid to said ice, agitating the ice in said storage zone and discharging an outlet ice slurry from said storage zone through ice transport means when ice is required.

16. The method of claim 15 wherein the liquid added to said ice is obtained by recycling the liquid drained in said storage zone to said ice in said storage zone.

17. The method of claim 15 wherein liquid is added to said ice by spraying said ice in said storage zone with brine.

18. The method of claim 15 further comprising the step of recycling the liquid drained in said storage zone to said separation zone.

19. The method of claim 42 wherein the liquid is added to said ice by spraying said ice in said storage zone with fresh water.

20. The method of claim 9 wherein said salt water is obtained from the liquid bath in said separation zone.

21. The method of claim 16 wherein liquid is added to said ice by spraying said ice in storage zone with brine.

22. A method of storing and distributing ice comprising the steps of:

introducing an inlet slurry of fine particulate ice and solution into a separation zone;

allowing the slurry to separate into an ice bed and a liquid bath in said separation zone;

agitating said ice bed in an agitation zone;

discharging agitated ice from said agitation zone;

introducing a first liquid into said agitated ice to form an outlet ice slurry; and allowing at least a portion of said outlet ice slurry to be recycled back into said separation zone when desired.

23. The method of claim 22 wherein the liquid introduced into said agitated ice is salt water.

24. The method of claim 23 wherein said salt water is removed from said separation zone and introduced into said agitated ice.

25. The method of claim 22 wherein the liquid introduced into said agitated ice is fresh water.

26. The method of claim 22 further including the step of adding a second liquid into the agitated ice, wherein the first liquid is fresh water and the second liquid is salt water.

27. The method of claim 26 wherein said salt water is removed from said separation zone and introduced into said agitated ice.

* * * * *